United States Patent [19]

Stigen

[11] Patent Number: 5,016,319

[45] Date of Patent: May 21, 1991

[54] HANDLE ASSEMBLY

[76] Inventor: Charles L. Stigen, R.R. 3, P.O. Box 67A, Mora, Minn. 55051

[21] Appl. No.: 509,476

[22] Filed: Apr. 16, 1990

[51] Int. Cl.[5] ..... E05B 7/00

[52] U.S. Cl. ..... 16/114 R; 16/115; 16/110 R; 404/119

[58] Field of Search ..... 16/114 R, 110 R, 115, 16/112, 111 A; 404/118, 119, 97

[56] References Cited

U.S. PATENT DOCUMENTS

| | | | |
|---|---|---|---|
| 3,130,444 | 4/1964 | Stollsteimer | 16/111 A |
| 4,050,728 | 9/1977 | Davidson | 16/114 R |
| 4,128,266 | 12/1978 | Vaslas | 16/114 R |
| 4,229,033 | 10/1980 | Vosbikian | 16/110 R |
| 4,256,416 | 3/1981 | Bishop | 404/119 |
| 4,615,553 | 10/1986 | Hultine | 16/115 |
| 4,828,427 | 5/1989 | Nisenbaum | 404/97 |
| 4,838,730 | 6/1989 | Owens | 404/97 |

*Primary Examiner*—Kurt Rowan
*Assistant Examiner*—Chuck Y. Mah
*Attorney, Agent, or Firm*—Jerold M. Forsberg

[57] ABSTRACT

A handle assembly for attachment to a screed includes a clamp sized to receive either a wooden screed or a metal screed, a power handle extending upwardly from and fixed to the clamp for controlling the attitude of the screed and applying power to pull the screed over freshly poured concrete, and a pivoted handle pivoted relative to the power handle for applying downward pressure and lifting forces to the screed. A single handle assembly can be used with a short screed or multiple handle assemblies can be used with longer screeds. The arrangement permits controlled movement during multiple passes of the screed over freshly poured concrete by a workman in a standing position.

15 Claims, 2 Drawing Sheets

HANDLE ASSEMBLY

BACKGROUND OF THE INVENTION

The present invention relates generally to an improved handle assembly, and more specifically to a handle assembly which when used with a screed permits workmen to be more comfortable by standing while manipulating the screed back and forth over freshly poured concrete.

The prior art shows a number of different approaches to the problem of finding a way for workmen to stand while manipulating a screed. One such device, disclosed in U.S. Pat. No. 4,828,427, utilizes a combined handle where one handle is fixed to extend transversely relative to a second handle with both handles being pivotable as a unit relative to a bracket which in turn is clamped to a screed. A significant problem with this device is a lack of leverage, e.g., when the screed encounters a build-up of cement it becomes very difficult for the user to pull the screed and yet maintain the screed in a proper orientation relative to the concrete. Additionally, the device is awkward to lift and position with the screed attached, e.g., when multiple passes over freshly poured concrete are needed. Another prior art device, disclosed in U.S. Pat. No. 4,449,845, shows an apparatus attached to a screed and to a harness secured about a users' waist. This arrangement permits lifting of the screed but has an inherent problem of limiting movement of the screed when it is in contact with the concrete to when the user is walking backward. Yet another prior art device, disclosed in U.S. Pat. No. 4,256,416, shows a pair of handles fixed relative to one another, one of which extends straight upwardly from its attachment to the screed while the other extends laterally outwardly. A significant problem encountered in using this device is the difficulty in applying downward pressure on the upwardly extending handle while pulling the screed with the laterally outwardly extending handle because of the fixed orientation of the handles. Similarly, a problem of improper leverage is apparent when the screed is to be lifted because the user is required to lift the screed by using the upwardly extending handle. Finally, another prior art device, disclosed in U.S. Pat. No. 2,897,735, describes a device attached to a screed and connected to a belt worn by the user by chains. The screed is moved side to side by the user swaying as he walks slowly backward. This device is not concerned with lifting the screed and the difficulty in lifting the screed with this device attached to it and repositioning the screed for a second pass over fresh concrete is readily apparent.

Accordingly, the problems of the prior art devices are not found in the present invention and the age old problem of workers screeding concrete bent over or on their knees has been answered.

SUMMARY OF THE INVENTION

The handle assembly of the instant invention is particularly advantageous due to the ease with which a workman can maneuver a screed to level freshly poured concrete while working in a generally upright standing position. It is anticipated that for longer screeds at least two handle assemblies in accordance with the instant invention can be used to permit workmen to work together to level freshly poured concrete while working in a generally upright condition.

The handle assembly of the instant invention includes a U-shaped clamp sized for attachment of the assembly to either a 2×4 wooden screed or to a 2 inch thick metal screed. The clamp includes a pair of bolts threaded so as to extend through one leg of the clamp and a removable shim which has been found to be advantageous when used with a wooden screed to spread the clamping force applied by the bolt.

The assembly also includes a pair of handles of which one is a power handle fixed relative to the clamp at about a 45 degree angle while the other is a pivoted handle pivoted at one end to the power handle. The handles are both length adjustable and adjustable such that the direction of the axis of each handle grip may be changed to suit the workers' preference. The power handle is used by a workman to supply power to pull the screed over freshly poured concrete while at the same time controlling the orientation of the screed relative to the concrete. The pivoted handle is used to provide downward pressure on the screed, when needed, and to provide the primary lifting force when the screed is to be moved.

The assembly includes a provision for mounting the pivoted handle on either side of the power handle. A stop extends to either side of the power handle such that the pivoted handle is, in one pivoted position, kept from dropping into the concrete and, in another pivoted position, used as a counterbalance. Also included is a parking shoe which extends rearwardly toward the workman from the clamp for supporting the assembly, when attached to a screed, in a generally upright condition when left unattended.

The assembly can be fabricated economically of sturdy materials and can be coated to inhibit corrosion and the bonding of concrete thereto. Preferred materials include steel and wood.

It is an object of the present invention to provide an improved handle assembly which permits a workman to screed concrete without having to work on his knees or in a bent over condition thereby avoiding fatigue and back and knee injuries.

It is also an object of this invention to provide a handle assembly for a screed which is economical to build and easy to use.

Other objects and advantages of the present invention will be apparent and understood from the following detailed description when taken in conjunction with the accompanying drawings.

BRIEF DESCRIPTION OF THE DRAWING

A handle assembly constructed in accordance with this invention is described below with reference to the accompanying drawings, wherein.

DETAILED DESCRIPTION OF THE INVENTION

Figure 1:
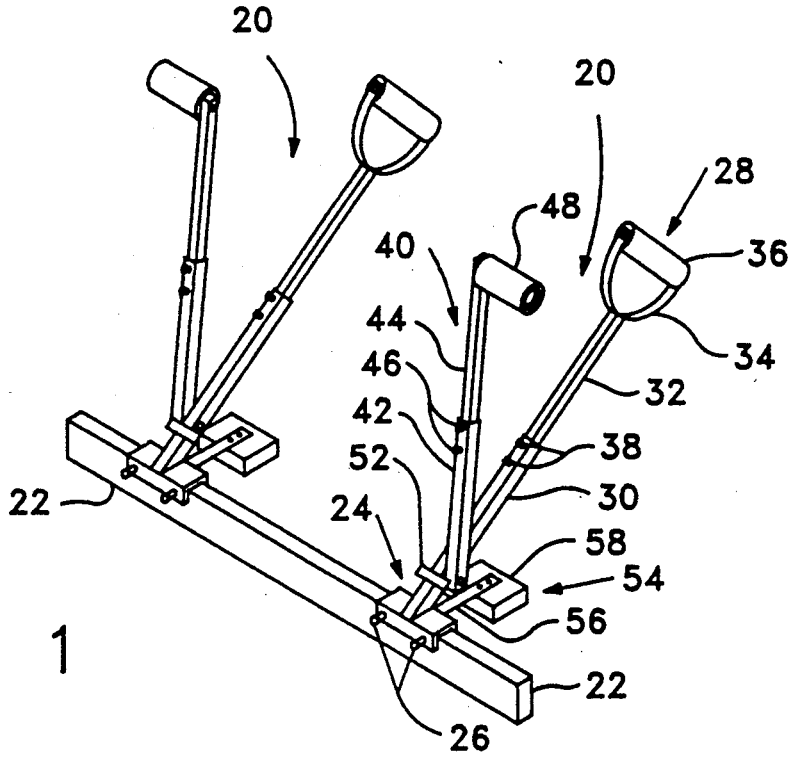
FIG. 1 is a perspective view of a pair of handle assemblies, constructed in accordance with the instant invention, attached to a screed, one assembly set up for left hand operation and one assembly set up for right hand operation.

Referring now to the drawings in more detail wherein like numerals have been employed to designate similar parts throughout the various figures.

The preferred embodiment of the present invention is illustrated as a handle assembly and is generally designated by the numeral 20. As depicted in FIG. 1, a pair of handle assemblies 20 are shown attached to the ends of a long screed 22. In view of the fact that both of the handle assemblies utilize all the same structural components only one of the handle assemblies will be described in detail.

Figure 3:
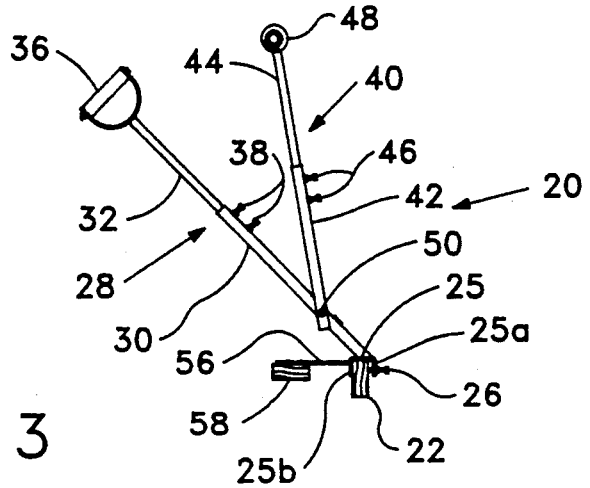
FIG. 3 is a side view of the handle assembly of FIG. 2 with the pivoted handle in a position ready for use by a workman.

Each handle assembly 20 includes a clamp assembly 24 for attachment of the handle assembly 20 to screed 22. Clamp assembly 24 includes a downwardly opening U-shaped channel 25 sized to receive a wooden screed such as a 2×4 or a 2×6 as well as a full 2 inch thick metal screed. As best seen in FIG. 3, a pair of bolts 26 are threaded through leg 25*a* of U-shaped channel 25 and cooperate with leg 25*b* of channel 25 to clamp screed 22 therebetween. As an alternative to threading bolts 26 through leg 25*a*, holes may be punched or drilled through leg 25*a* and a threaded nut aligned with each hole and welded in place. When a wooden screed is used it is anticipated that a metal shim (not shown) may be employed between the ends of the bolts and the screed to spread the force applied to the screed by the bolts thereby preventing splitting of the wood.

Figure 4:
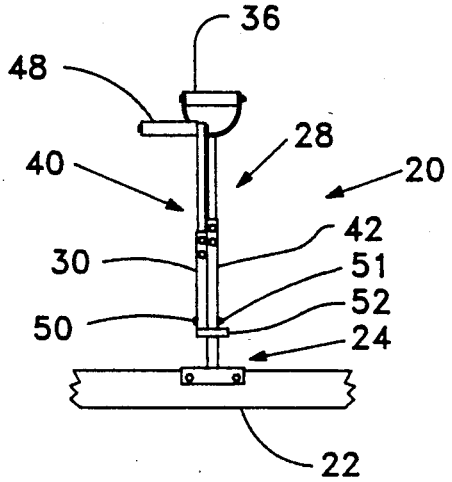
FIG. 4 is a front view of the assembly as seen in FIG. 3.
Figure 5:
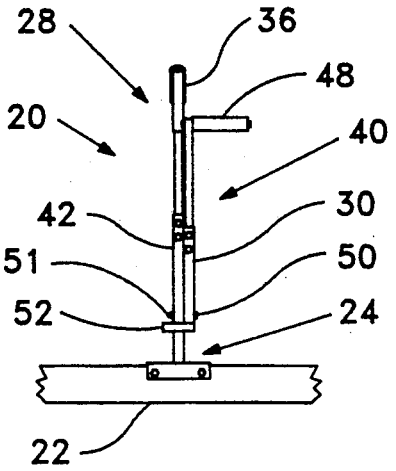
FIG. 5 is a front view, similar to FIG. 4, with the pivoted handle mounted on the opposite side of the fixed power handle.

Power handle 28 includes a fixed lower portion 30 secured to the U-shaped channel 25 of clamp assembly 24 by suitable means such as welding and a telescopically adjustable upper portion 32 received by the lower portion 30. Lower portion 30 extends upwardly from channel 25 at an angle of preferably 45 degrees. Upper portion 32 and lower portion 30 are preferably formed of square steel tube and sized such that the former fits snug and is telescoped within the later. Upper portion 32 has a C-shaped steel hand guard 34 secured thereto, preferably by welding, with a hand grip 36 extending between the free ends of C-shaped hand guard 34. Bolts 38 are threaded through the top side of lower portion 30 near the upper end thereof for securing the upper portion 32 in selected telescoped positions. Again, as an alternative to threading bolts 38 through lower portion 30, holes may be punched or drilled and a threaded nut aligned with each hole and welded in place. Hand grip 36 may be positioned either vertically or horizontally (see FIGS. 3, 4, and 5) by releasing bolts 38, withdrawing the upper portion 32, rotating upper portion 32 90 degrees, telescoping upper portion 32 back into lower portion any desired amount 30, and securing the bolts 38.

Pivoted handle 40 includes a pivoted lower portion 42 and telescopically adjustable upper portion 44. Lower portion 42 has a pair of bolts 46 threaded through the top side near the upper end thereof for securing the telescoped upper portion 44 in selected positions. Here again, threaded nuts may be used in the manner as indicated above on lower portion 30. Upper portion 44 includes an orthogonal hand grip 48 extending outwardly and generally perpendicularly from its upper end. Lower portion 42 and upper portion 44 are preferably constructed of the same materials and in the same manner as the lower and upper portions 30, 32 of power handle 28.

Lower portion 42 is pivoted to power handle 28 about 6 inches above where the fixed lower portion 30 is welded to the clamp assembly 24 by a removable pivot pin 50 (see FIG. 3). Pivot pin 50, which is preferably a bolt, passes through aligned apertures near the end of the pivoted lower portion 42 and aligned apertures in fixed lower portion 30 and is secured relative thereto by a nut 51. The advantage of this arrangement being that when two workmen are using a pair of handle assemblies in accordance with this invention and they wish to position the handle assemblies near opposite ends of a screed and walk outside of forms holding freshly poured concrete, the pivoted handles may be positioned to extend either to the user's right or left whichever is more comfortable (see FIG. 1). Another advantage is when a handle assembly is positioned near the end of a screed and the screed is being used near a wall the pivoted handle can be mounted so that the orthogonal hand grip extends away from the wall.

Figure 2:
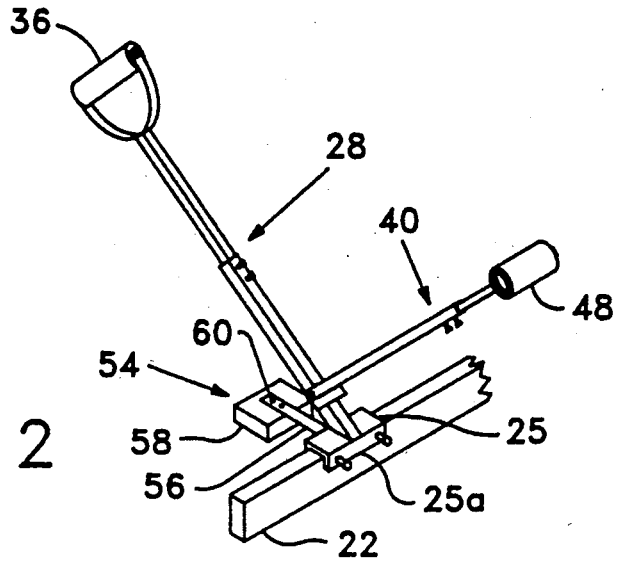
FIG. 2 is a perspective view of one of the handle assemblies shown in FIG. 1, the assembly being set up to be left unattended by a workman.

Fixed lower portion 30 includes a stop 52 attached thereto by suitable means such as welding. Stop 52 extends beyond both sides of lower portion 30 in a predetermined location such that pivoted handle 40 is precluded, in one position, when both handles are on the same side of screed 22, from dropping past power handle 28 (see FIG. 3) and, in another position, when the hand grip 36 and the orthogonal hand grip 48 are disposed on opposite sides of screed 22 (see FIG. 2), stopped in a counter-balance position.

Handle assembly 20 includes a parking assembly 54 for supporting the handle assembly 20 when it is attached to screed 22 and left unattended by workmen. The obvious advantage of such an arrangement is that the handle assembly 20 is kept clean and uncontaminated by concrete or dirt when in a generally upright condition. Parking assembly 54 includes a rearwardly extending arm 56 which is attached at one end to the clamping assembly by, for example, welding and has a parking shoe 58 attached to the free end thereof by threaded fasteners 60 (see FIG. 2). Parking shoe 58 is preferably wood, e.g. a piece of 2×4. While the parking assembly 54, depending on the size of the parking shoe 58 and the length of arm 56, may be sufficient to support the handle assembly 20 in an upright condition when attached to a screed and left unattended, it has been found that pivoting the pivoted handle 40 to a position where the orthogonal hand grip 48 is on the opposite side of the screed from the hand grip 36 counter-balances the handle assembly 20 such that it may safely be left unattended.

Referring now to FIGS. 1 and 3, to use the handle assembly a workman attaches the handle assembly 20 to a screed 22 by setting the U-shaped channel 25 of clamping assembly 24 on screed 22 and tightening bolts 26 to clamp the screed against leg 25*b*. Power handle 28 and pivoted handle 40 are then adjusted by loosening bolts 26 and 38, respectively. Once the handles 28 and 40 are comfortably positioned, bolts 26 and 38 are retightened and a workman can then grasp hand grip 36 with one hand and orthogonal hand grip 48 with the other hand and lift the screed 22 by holding hand grip 36 steady while pulling on orthogonal hand grip 48. Screed 22 can then be positioned and set down on the freshly poured concrete and pulled over the concrete in a leveling operation. The workman applies pulling forces to screed 22 through power handle 28 while at the same time using power handle 28 to maintain the attitude of screed 22 relative to the concrete. Pivoted handle 40 is used simultaneously with power handle 28 to apply downward pressure on screed 22 to thereby make screed 22 more effective. Concrete invariably requires more than one pass over it by a screed before it is level. Thus, screed 22 must be moved for multiple passes. Accordingly, at the end of each pass, the workman will again hold orthogonal hand grip 36 steady and pull on hand grip 48 to lift the screed. He will then position the screed for another pass, repeating the process until the concrete is satisfactorily level. Typically a job involving the pouring of concrete is done in stages and, accordingly, the workman can park the screed and attached handle assembly 20 by pivoting pivoted handle 40 to its counter-balance position against stop 52 and resting the handle assembly on parking shoe 58.

It should be understood that other forms of the handle assembly are contemplated by the present invention and that numerous modifications may be made by those of skill in the art without departing from the scope and spirit of the invention.

I claim:

1. A handle assembly for use with a screed, the handle assembly comprising:

clamp means for attachment to a screed;

power handle means for controlling the attitude of the screed and applying power to pull the screed fixed at one end to said clamp means and extending upwardly at a predetermined angle relative to said clamp means to a hand grip means at another end; and pivoted handle means for applying downward pressure and lifting forces to said screed having an orthogonal handle means at one end and another end pivotally attached relative to said power handle means about a generally horizontally extending pivot means disposed on said power handle means, said pivot means selectively accommodating pivoting of said pivoted handle means on either side of said power handle means.

2. A handle assembly as set forth in claim 1 wherein said power handle means extends upwardly at substantially 45 degrees.

3. A handle assembly as set forth in claim 1 wherein said clamp means includes a downwardly opening generally U-shaped channel sized to receive an edge of a screed therein.

4. A handle assembly as set forth in claim 3 wherein said channel of said clamp means includes at least one fastener means for releasably securing an edge of said screed within said channel.

5. A handle assembly as set forth in claim 4 wherein said fastener means includes a removable shim for use with a wooden screed.

6. A handle assembly as set forth in claim 4 wherein said fastener means includes a pair of threaded bolts, said bolts being threaded through a leg of said channel.

7. A handle assembly as set forth in claim 1 wherein said power handle means includes a fixed lower portion having one end fixedly secured relative to said clamp means and a free open end, an upper adjustable portion having the hand grip means at one end and another end telescopically received by the free open end of said fixed lower portion, and fastener means for securing said upper adjustable portion relative to said fixed lower portion.

8. A handle assembly as set forth in claim 7 wherein said fixed lower portion and said upper adjustable portion are made of complementary sized square tube whereby said hand grip means can be selectively positioned to extend generally vertically or horizontally.

9. A handle assembly as set forth in claim 8 wherein said pivoted handle means includes a pivoted lower portion having one end pivotally secured to said power handle means by said horizontally disposed pivot and a free open end, an upper portion having the orthogonal handle means at one end and an end telescopically received by the free open end of said pivoted lower portion, and fastener means for securing said upper portion relative to said pivoted lower portion.

10. A handle assembly as set forth in claim 9 wherein said power handle means extends upwardly at generally 45 degrees from said clamp means.

11. A handle assembly as set forth in claim 9 wherein said pivoted lower portion and said upper portion are made of complementary sized square tube.

12. A handle assembly as set forth in claim 1 wherein said handle assembly includes a parking means extending substantially horizontally below said power handle means for supporting the handle assembly in a generally upright position when attached to a screed and left unattended.

13. A handle assembly as set forth in claim 1 wherein said power handle means includes stop means extending substantially perpendicularly from opposite sides thereof at a predetermined location, said stop means precluding pivoting of said pivoted handle means, in one direction, downwardly past said power handle means and, in another direction, past a position handle means relative to said power handle means wherein the pivoted handle means functions to counter balance said handle assembly when left unattended.

14. A handle assembly for use with a screed for leveling material such as concrete, comprising:

screed clamp means having a downwardly opening generally U-shaped channel sized to receive a screed therein, said clamp means including at least one fastener adjustably threaded through one leg of the channel and cooperating with an opposite leg of the channel for securely clamping a screed relative thereto;

first handle means including a fixed lower portion of square tube fixedly secured to said screed clamp and an adjustable portion sized to be telescopically received in said fixed lower portion, said fixed lower portion extending upwardly at a predetermined angle from the screed clamp means;

second handle means a tubular pivoted lower portion and an upper portion sized to be telescopically received in said pivoted lower portion;

first fastener means disposed on said fixed lower portion of said first handle means for securing the respective adjustable portion relative thereto;

second fastener means disposed on said pivoted lower portion of said second handle for securing the upper portion relative thereto;

generally horizontally extending pivot pin means disposed on said fixed lower portion of said first handle means for pivotally connecting one end of the pivoted lower portion of the second handle means thereto, said pivot pin being adapted to be disposed on opposite sides of said fixed lower portion wherein said second handle means may be operably disposed on either side of said first handle means;

parking shoe means affixed to and extending substantially horizontally from the screed clamp means, said parking shoe means being disposed generally below said first handle means such that said parking shoe means will support said handle assembly in a generally upright position when attached to a screed and left unattended; and stop means affixed at a predetermined location to the fixed lower portion of said first handle means, said stop means extending outwardly from opposite sides of said fixed lower portion such that in one direction said second handle means is precluded from pivoting downwardly past said first handle means and in another direction is stopped in a position to counter-balance said handle assembly in a generally upright position when attached to a screed and left unattended;

whereby said first handle means of the handle assembly is used for controlling the attitude of the screed relative to material being leveled and for applying pulling power to pull the screed over the material and said second handle means is used for applying downward pressure on the screed and for cooperating with said first handle means to lift said screed when the screed is to be positioned and pulled over the material.

15. A handle assembly as set forth in claim 3 wherein said first handle means extends upwardly from the screed clamp means at generally 45 degrees.

* * * * *